US006918150B1

(12) United States Patent
Robinson

(10) Patent No.: US 6,918,150 B1
(45) Date of Patent: Jul. 19, 2005

(54) COMBINED NUTCRACKER AND BOTTLE OPENER

(76) Inventor: Paul P. Robinson, 217 River Bend Dr., Chesterfield, MO (US) 63017

( * ) Notice: Subject to any disclaimer, the term of this patent is extended or adjusted under 35 U.S.C. 154(b) by 0 days.

(21) Appl. No.: 10/670,635

(22) Filed: Sep. 25, 2003

(51) Int. Cl.[7] ..... B57B 7/00
(52) U.S. Cl. ..... 7/151; 7/110; 81/3.09; 81/3.44
(58) Field of Search ..... 7/151, 110; 81/3.09, 81/3.44, 3.55

(56) References Cited

U.S. PATENT DOCUMENTS

D114,211 S * 4/1939 Francke ..... 81/3.09
D141,865 S * 7/1945 Smith ..... D7/680
2,729,125 A * 1/1956 Krzanowski ..... 7/151
2,778,254 A * 1/1957 Carapellotti ..... 7/151
3,389,622 A * 6/1968 Flugel ..... 81/3.09
D304,891 S 12/1989 Borromeo
D347,555 S 6/1994 Steinbach
D494,820 S * 8/2004 Powell ..... D7/680

* cited by examiner

*Primary Examiner*—James G. Smith
(74) *Attorney, Agent, or Firm*—Haverstock, Garrett & Roberts LLP

(57) ABSTRACT

A combined nutcracker and bottle opener, including an element usable for holding and cracking the hard outer shell of a nut and also for holding and twisting a cap from a bottle, and an element for prying a cap from a bottle, which can have an outer shape resembling the lower torso and legs of a human body.

19 Claims, 5 Drawing Sheets

COMBINED NUTCRACKER AND BOTTLE OPENER

TECHNICAL FIELD

This invention relates generally to a nutcracker and a bottle opener, and more particularly, to a nutcracker which can include an element usable for cracking the hard outer shell of a nut and also for holding and twisting a cap from a bottle, and an element for prying a cap from a bottle.

BACKGROUND OF THE INVENTION

It is well known to use plier type devices for cracking the hard outer shells of consumable nuts. Various plier type devices are known for loosening and twisting caps from bottles and jars. Also, various bottle openers for prying caps from bottles are known. A combined nutcracker and bottle opener for removing plugs of bottles is disclosed in Borromeo U.S. Pat. No. Des 304,891 issued Dec. 5, 1989.

Apparent shortcomings of providing different devices for cracking nuts, twisting caps from bottles and prying caps from bottles, include costs of purchasing the different devices, storage requirements for the devices, and clutter on bar tops and tables. Pry-off type bottle caps commonly found on soft drink bottles and beer bottles in the U.S.A. are typically difficult to twist off, and when twist-off caps are pried off there is a danger of inadvertently breaking the top glass lip of the bottle. Observed shortcomings of the combined nutcracker and bottle opener of the Borromeo patent include relatively complex manufacture requiring multiple pinned connections and resultant cost, and a lack of disclosed utility for opening bottles by other than removing plugs therefrom.

Thus, what is sought is a combination nutcracker and bottle opener which is simple to manufacture, can incorporate elements for twisting and/or prying caps from bottles, and which can be incorporated into an aesthetically pleasing shape.

SUMMARY OF THE INVENTION

What is disclosed is a combined nutcracker and bottle opener which overcomes one or more of the shortcomings listed above, and which can include a desired combination of elements for cracking a hard outer shell of a nut, twisting a cap from a bottle, and/or prying a cap from a bottle, and which additionally can have an aesthetically pleasing shape and is simple to manufacture.

According to one aspect of the invention, the combined nutcracker and bottle opener includes first and second body members each having a first end portion and a second end portion opposite the first end portion, the first end portions being connected in overlapping relation for relative pivotal movement about a pivotal axis therethrough for allowing pivotally moving the second end portions between a substantially overlapping position and a range of angularly related positions about the pivotal axis. The second end portion of the second body member includes a bottle opener which is at least substantially covered by the first body member when in the overlapping position and which is uncovered and usable when the second end portions are in at least one of the angularly related positions. A pair of elongate legs having proximal end portions are connected to the second end portions of the body members, respectively, and extend outwardly from the body members. The legs are positioned in generally parallel, side-by-side relation when the second end portions of the body are in the overlapping relation, and are angularly related when the second end portions are in the angularly related positions, the legs having distal end portions opposite the proximal end portions thereof and elongate intermediate leg portions extending between the proximal and distal end portions, respectively. The intermediate leg portions adjacent the proximal ends of the legs have opposing portions adapted for receiving and holding a nut therebetween such that the legs can be grasped adjacent the distal end portions or elsewhere along the length thereof and squeezed toward one another for applying a compressive force against the nut for cracking a shell of the nut, and for holding and squeezing a cap on a bottle to allow relatively twisting the cap and the bottle for loosening the cap. The bottle opener that is exposed and usable when the legs are angularly related preferably includes a shallow slot facing the distal end of the leg for receiving a circumferential side of a bottle cap and an edge adjacent to the slot for engaging a lower side edge of the cap, the leg including an inner surface portion that preferably has a concave shape and is relatively wide and can be brought into contact with and hold and center an upper or top surface of the cap sufficiently to allow prying it from a bottle with an easy pivoting movement. This concave inner surface portion can also function as the inner surface portion for receiving and holding a nut.

According to another aspect of the invention, the proximal end or body portion of the second leg is cooperatively received in a slot in the proximal end or body portion of the first leg and pivotally connected thereto for relative pivotal movement of the legs generally on a plane through the sides of the legs between a position wherein the leg portions are generally parallel and a range of positions wherein the leg portions are angularly related. Again, the intermediate portions of the legs have opposing inner surface portions adjacent the proximal ends of the legs adapted for receiving and holding a nut or bottle cap therebetween such that the legs can be grasped and squeezed toward one another for applying a compressive force against the nut for cracking it, or against the cap for holding and twisting it from a bottle. The proximal end portion of the second leg includes the pry-off bottle opener which is concealed in the slot of the first leg when the legs are in the generally parallel closely spaced position and which is usably positioned when the legs are pivoted one relative to the other to an angularly related open position.

According to a preferred aspect of the invention, one or both of the opposing inner surface portions of the legs adapted for holding a nut and engaging the top of a bottle cap can be concave as viewed from the front and rear only, or concave all around so as to have a bowl or dish shape or other functional shape. The inner surface portion can also include a groove or a strip of a rubbery material adapted for conformingly holding or gripping a circumferential side or edge of a bottle cap as it is twisted loose from a bottle. The groove or strip should have a width at least marginally greater than the height of a conventional commercially available twist-off bottle cap used on soft drink and beer bottles in the USA and elsewhere. The groove or strip can include spaced recesses corresponding to a serrated pattern commonly found on the circumferential edge of a cap for more securely and positively gripping and holding it. Additionally, the combined nutcracker and bottle opener preferably has an aesthetically pleasing outer shape, such as that of the lower torso and legs of a human body.

An advantage of the present invention is that it provides the nutcracker in combination with either or both a bottle opener usable for prying a cap from a bottle and a bottle opener for twisting a cap from a bottle, so as to be more convenient and easy to use and require less storage and bar or table space.

Another advantage of the invention is that it can provide the above capabilities in a device which requires only one pivot joint so as to be relatively simple and economical to manufacture.

DETAILED DESCRIPTION OF PREFERRED EMBODIMENTS

Figure 3:
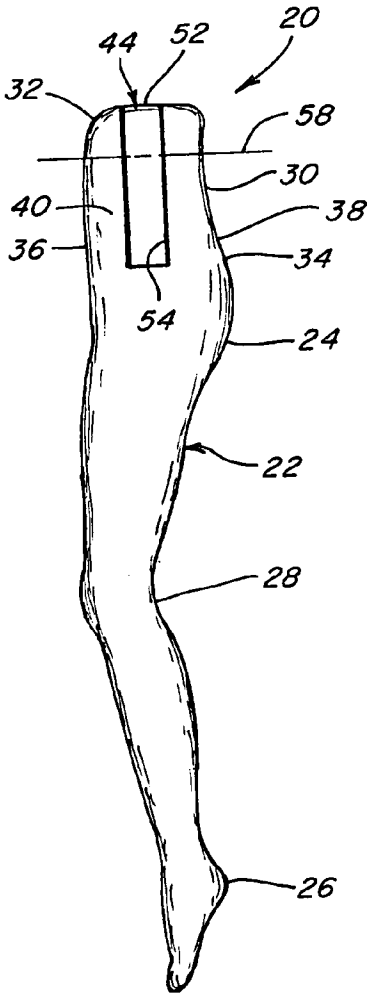
FIG. 3 is a left side view of the combined nutcracker and bottle opener.
Figure 2:
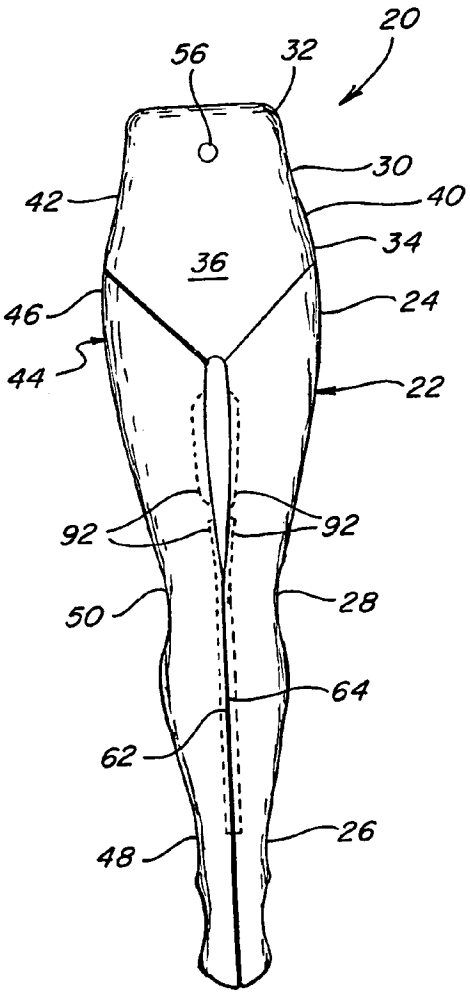
FIG. 2 is a front view of the combined nutcracker and bottle opener of FIG. 1.
Figure 1:
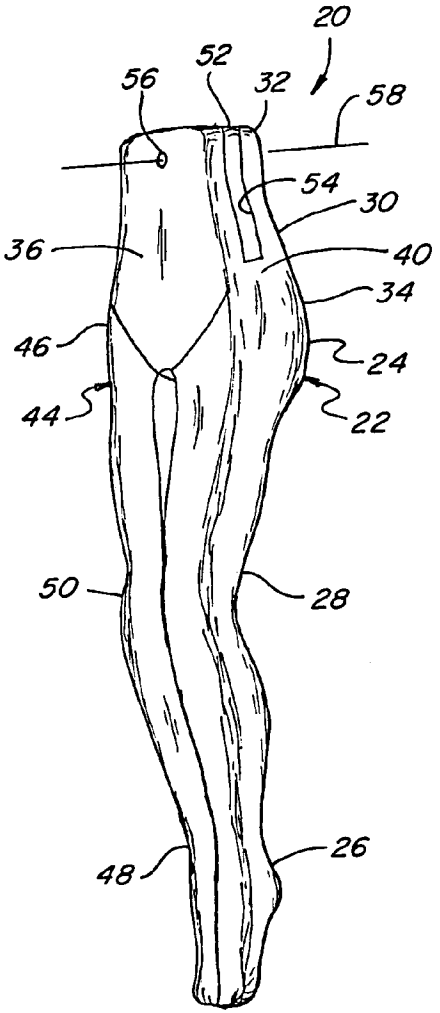
FIG. 1 is a perspective view of a combined nutcracker and bottle opener according to the present invention.
Figure 6:
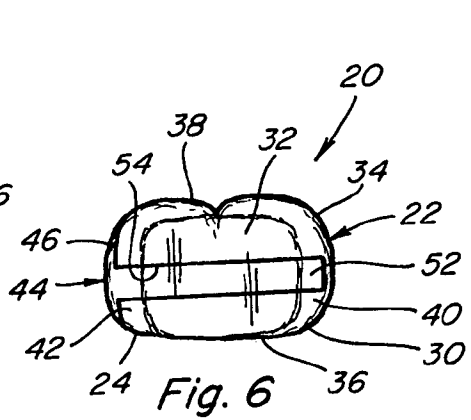
FIG. 6 is a top view of the combined nutcracker and bottle opener.
Figure 7:
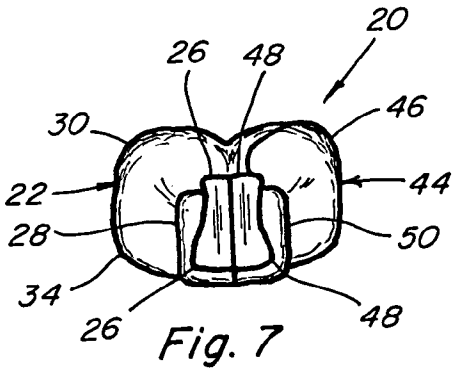
FIG. 7 is a bottom view of the combined nutcracker and bottle opener.
Figure 5:
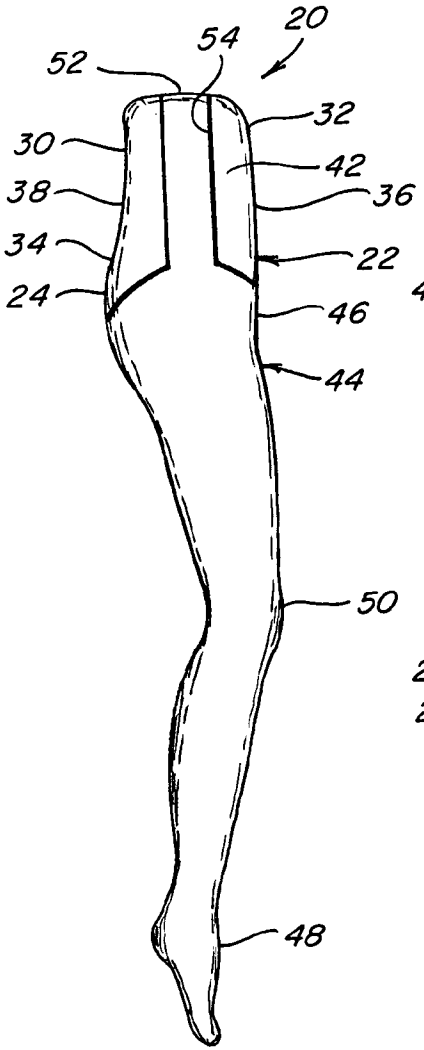
FIG. 5 is a right side view of the combined nutcracker and bottle opener.
Figure 4:
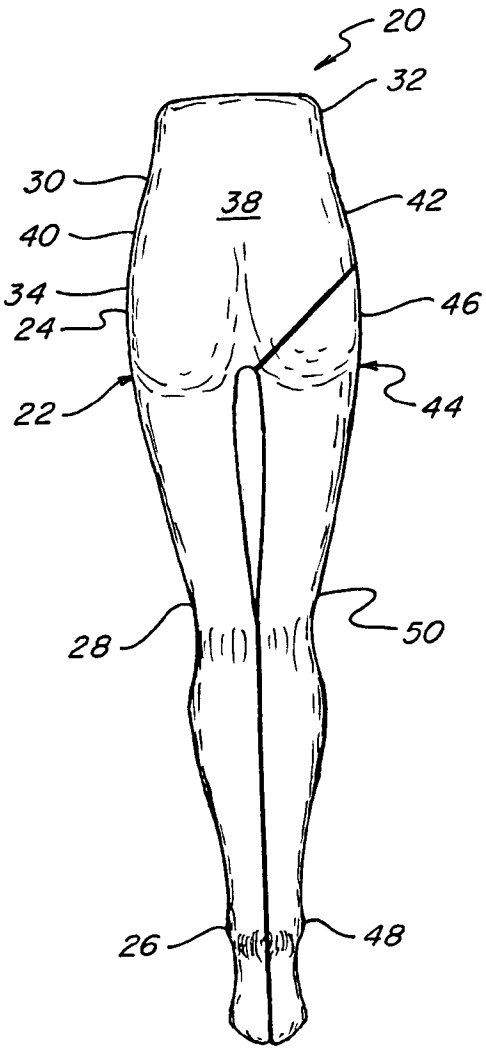
FIG. 4 is a rear view of the combined nutcracker and bottle opener.

Referring now to the drawings wherein like numbers refer to like parts, FIGS. 1–7 show various views of a combined nutcracker and bottle opener 20 constructed and operable according to the teachings of the present invention. As will be explained more fully below, combined nutcracker and bottle opener 20 is easily and conveniently usable for cracking the hard outer shells of a variety of nuts commonly consumed by humans, including, but not limited to, brazil nuts, walnuts, pistachios, and peanuts. Opener aspects of combined nutcracker and bottle opener 20 can be utilized for twisting off the well known commercially available twist-off type caps, and prying off those caps, as well as the well known commercially available pry off caps.

Nutcracker and bottle opener 20 includes a first elongate leg 22 having a proximal end portion 24, a distal end portion 26 opposite proximal end portion 24, and an intermediate leg portion 28 extending between proximal and distal end portions 24 and 26. A first body portion 30 is connected to proximal end portion 24 so as to extend longitudinally and sidewardly in cantilever relation thereto. First body portion 30 includes an upper portion 32, an opposite lower portion 34 which connects to proximal end portion 24, a front surface portion 36, an opposite rear surface portion 38, and opposite side surface portions 40 and 42 extending therebetween.

Combined nutcracker and bottle opener 20 additionally includes a second elongate leg 44 having a proximal end portion 46, a distal end portion 48, and an intermediate leg portion 50 extending therebetween.

Legs 22 and 44 are desirably pivotable one relative to the other about a forward to rearwardly extending axis therethrough adjacent proximal end portions 24 and 46. This is preferably achieved by providing a second body portion 52 connected to leg 44 extending longitudinally and sidewardly from proximal end portion 46 in cantilever relation thereto. Second body portion 52 preferably has a profile shape when viewed from the front or rear corresponding to that of first body portion 30, and further has a relatively narrow front to rear extent, so as to be cooperatively receivable in a longitudinally and sidewardly open slot 54 in body portion 30. Body portions 30 and 52 are connected together by a pin 56 extending therethrough for relative pivotal movement about a forwardly and rearwardly extending pivotal axis 58, as variously illustrated in FIGS. 8–13 and discussed below.

More particularly, as shown in FIGS. 1–7, legs 22 and 24 can be positioned in a generally parallel, closed position, and can be relatively pivoted from that position through a range of angularly related positions up to and including about 300° apart, as illustrated by the various positions shown in FIGS. 8–13, for performing nutcracking and bottle opening functions. In this regard, legs 22 and 44 are shown relatively pivoted to an angularly related open position for receiving a nut 60 between opposing inner surface portion 62 and 64 of intermediate leg portions 28 and 50 adjacent proximal end portions 24 and 46. In this position, the legs are squeezable one toward the other, as denoted by the arrows A, for exerting a compressive force against nut 60 for cracking its outer shell in the well known manner. To facilitate the holding of nut 60 in the desired position adjacent proximal end portions 24 and 46, one or more of inner surface portions 62 and 64 can include an element such as a concave receptacle such as receptacles 66 and 68 therein adapted for receiving and cradling opposite portions of a nut. Here, receptacles 66 and 68 have a three dimensional bowl or dish shape, but it should be understood that it is contemplated that other shapes could also be used, as well as other means for holding a nut, such as a surface which is roughened, or one including serrations or teeth, or a rubbery pad, or the like.

Figure 9:
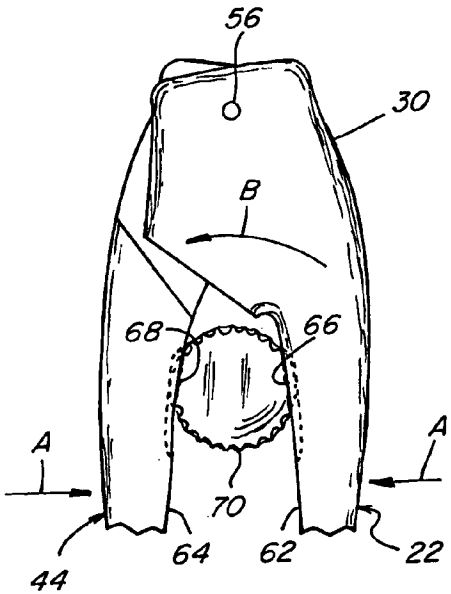
FIG. 9 is a fragmentary front view of the combined nutcracker and bottle opener showing the legs angularly related with a bottle cap squeezed therebetween for twisting from a bottle.

Referring to FIG. 9, inner surface portions 62 and 64 of legs 22 and 44 can be pivotally positioned in spaced apart relation for receiving a conventional twist-off type bottle cap 70 therebetween and squeezed as denoted by arrows A for holding the bottle cap to allow twisting it relative to a bottle on which it is located (not shown) as denoted by arrow B for loosening and removing the bottle cap from the bottle. Again, concave receptacles 66 and 68 are shown to facilitate locating and holding bottle cap 70.

Figure 10:
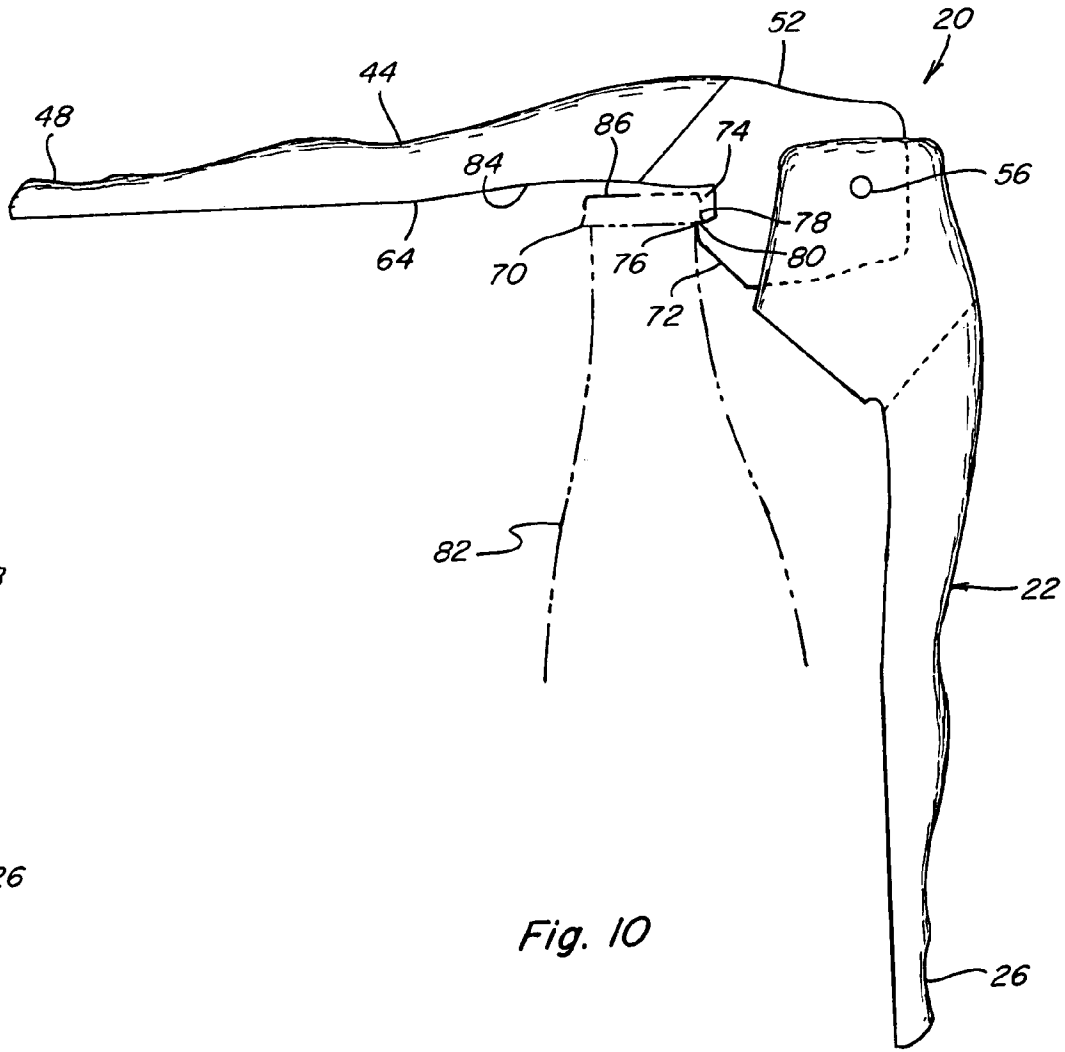
FIG. 10 is a front view of the combined nutcracker and bottle opener showing the legs pivoted to an angularly related position for revealing a bottle opener thereof in position for prying a cap from a bottle shown in phantom.
Figure 8:
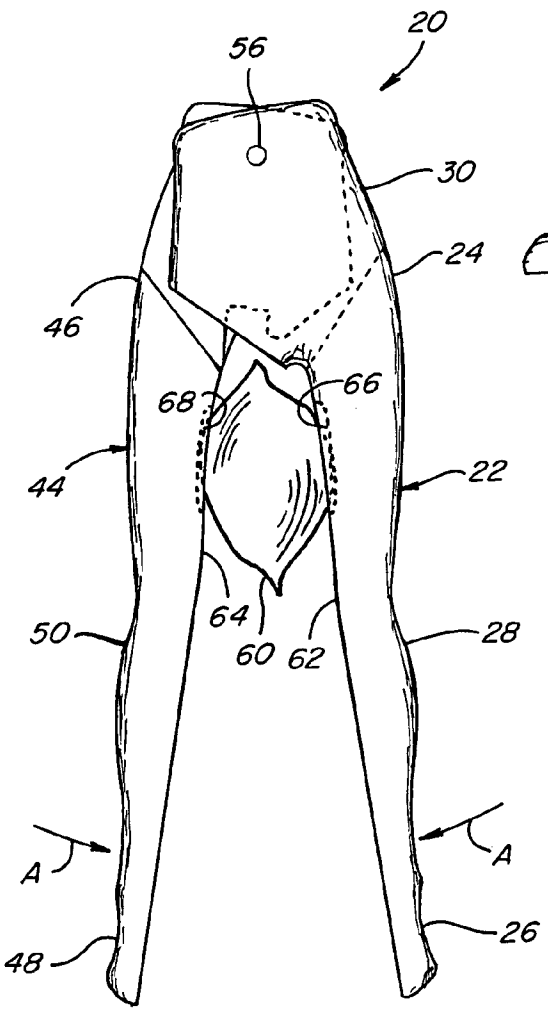
FIG. 8 is a front view of the combined nutcracker and bottle opener showing legs thereof pivoted to an angularly related position for receiving and holding a nut therebetween.
Figure 11:
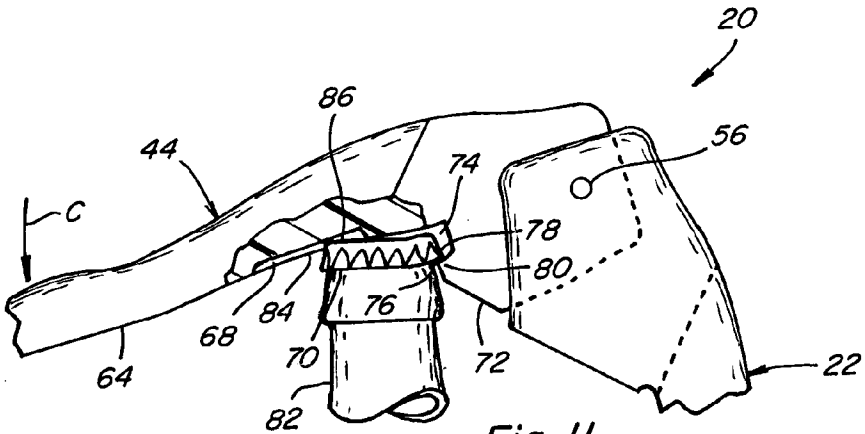
FIG. 11 is a fragmentary front view of the combined nutcracker and bottle opener, showing the legs in the angularly related position of FIG. 10 and the leg including the bottle opener pressed against a top surface of a bottle cap with an adjacent edge of the bottle opener engaged with a circumferential edge of the cap for prying it from a bottle.

FIGS. 10 and 11 show legs 22 and 44 pivoted to an open position about 90° apart to reveal a bottle opener 72 on second body portion 52 of leg 44. Bottle opener 72 is at least substantially concealed in or covered by body portion 30 of leg 22 when legs 22 and 44 are in the closed position and closer together angularly related positions, such as that shown in FIGS. 8 and 9. Bottle opener 72 includes a slot 74 generally facing distal end portion 48 extending from inner surface portion 64 to an opposing edge 76 on body portion 52. Slot 74 has a width from surface 64 to edge 76 which is preferably just marginally greater than a heighth of a conventional commercially available crimped bottle cap 70 so as to be capable of receiving a circumferential side portion 78 of cap 70 such that edge 76 is positioned for contacting a lower circumferential edge portion 80 of the cap for prying it from a bottle, such as bottle 82 shown, when leg 44 is pivoted about the cap as denoted by arrow C in FIG. 11. To facilitate the centering of leg 44 on cap 70, inner surface portion 64 preferably has a concave region 84 positioned for contacting an upper surface portion 86 of cap 70 opposite and spaced from circumferential side portion 78 and edge portion 80. Concave region 84 can optionally include the previously discussed concave receptacle 68 as shown in FIG. 11, for more positively centering leg 44 with respect to bottle cap 70 and to provide a sharper angle with respect to edge 76 of opener 72 for facilitating and enhancing the prying action of opener 72.

Figure 12:
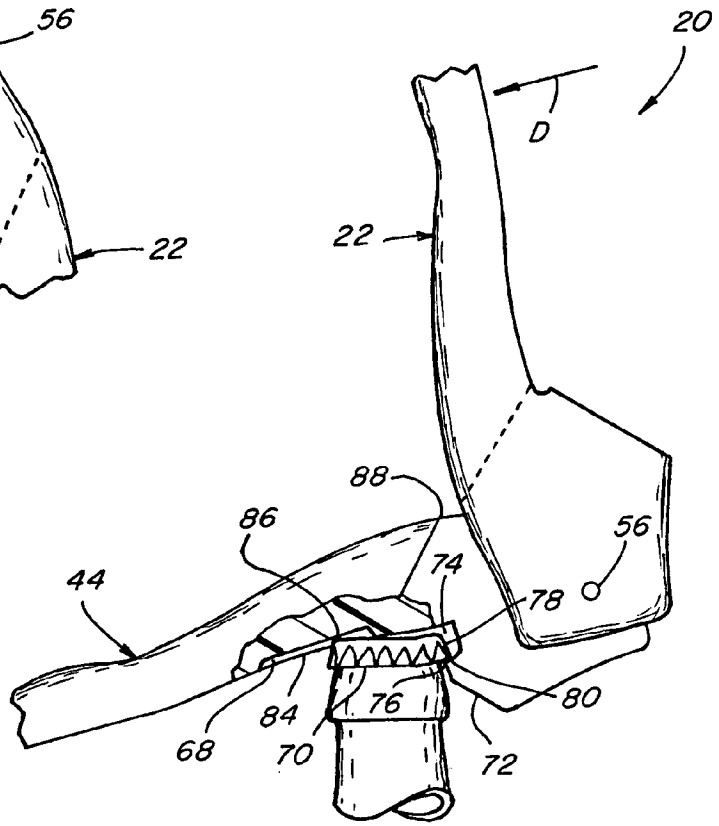
FIG. 12 is another fragmentary front view of the combined nutcracker and bottle opener, showing the legs pivoted to another angularly related position for prying a bottle cap from a bottle.

Referring to FIG. 12, leg 22 is shown pivoted to almost its maximum extent from the closed position relative to leg 44 so as to be capable of being brought to bear against an edge 88 of leg 44, for prying a cap 70 from a bottle 82 using opener 72. As before, circumferential side portion 78 of cap 70 is receivable in slot 74, such that edge 76 of opener 72 can be brought to bear against circumferential edge portion 80 of cap 70 and concave region 84 can contact upper surface portion 86 of the cap for prying it from the bottle. Also again, concave region 84 can include a receptacle 68 for receiving and cradling upper surface portion 86 of cap 70 to facilitate centering the opener on the cap. Here, the force for applying the prying action against cap 70 is exerted against leg 22, as denoted by arrow D, which has been found to provide somewhat greater leverage or mechanical advantage for prying compared to when prying using leg 44.

Figure 13:
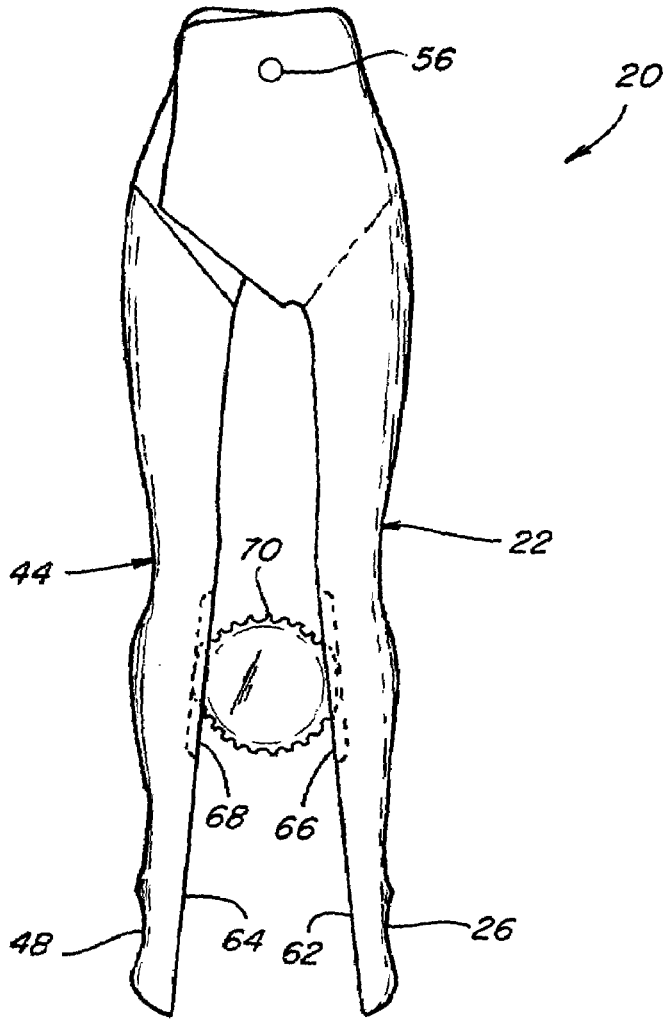
FIG. 13 is a front view of the combined nutcracker and bottle opener showing the legs angularly related with a bottle cap disposed between inner surface portions thereof for twisting the cap from a bottle.

Turning to FIG. 13, combined nutcracker and bottle opener 20 is shown including optional concave receptacles 66 and 68 on inner surface portions 62 and 64 at an optional location closer to distal ends 26 and 48, respectively. This can be in addition to or instead of those receptacles discussed earlier in reference to FIGS. 8 and 9, and provides another convenient location for engaging a bottle cap, such as bottle cap 70, for twisting it from a bottle.

Figure 14:
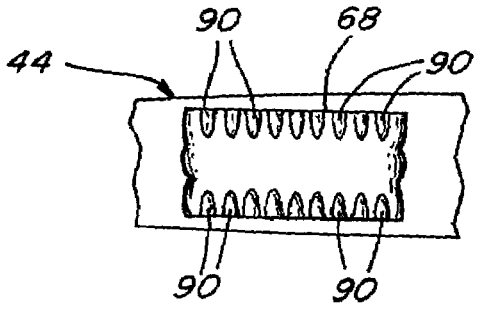
FIG. 14 is a fragmentary side view of an inner surface of one of the legs of the combined nutcracker and bottle opener, showing an optional groove including serrated portions for gripping a serrated circumferential edge of a bottle cap.

As shown in FIG. 14, receptacle 66 and/or receptacle 68 can include a pattern of recesses 90 adjacent the longitudinally extending sides thereof for engaging a serrated portion of a cap such as cap 70 to provide better gripping. Other elements for enhancing gripping action of nuts and bottle caps can include, but are not limited to, soft rubbery strips or the like, and can be located at any desired longitudinal location on inner surface portions 62 and 64, as denoted by elements 92 in FIG. 2. As a result, combined nutcracker and bottle opener 20 is adapted for use for cracking the hard outer shells of common edible nuts, and also loosening and removing both pry-off and twist-off caps commonly found on popular soft drink and alcoholic beverage bottles. Legs 22 and 44 can also be squeezed about corks and plugs of bottles such as wine bottles, for loosening and/or removing them. The single pivotal connection of the legs of the present device makes it simple to manufacture from a variety of common materials, including, but not limited to, wood, plastics, and/or metal. Advantageously, the combined nutcracker and bottle opener of the present invention is well suited to have the shape of the lower torso and legs of a human body, as evident from the illustrations, although other shapes can also be used.

Thus, there has been shown and described a novel nutcracker and bottle opener, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A combined nutcracker and bottle opener, comprising:

first and second body members each having a first end portion and a second end portion opposite the first end portion, the first end portions being connected in overlapping relation for relative pivotal movement about a pivotal axis therethrough for allowing pivotally moving the second end portions between a substantially overlapping position and a range of angularly related positions about the pivotal axis, the second end portion of the second body member including a bottle opener which is at least substantially covered by the first body member when in the overlapping position and uncovered and usably positioned when the second end portions are in at least one of the angularly related positions; and a pair of elongate legs having proximal end portions connected to and extending outwardly from the second end portions of the body members, respectively, the legs being positioned in generally parallel, side-by-side relation when the second end portions of the body members are in the overlapping relation and being correspondingly angularly related when the second end portions are in the angularly related positions, the legs having distal end portions opposite the proximal end portions thereof and elongate intermediate leg portions extending between the proximal and distal end portions, respectively, the intermediate leg portions adjacent the proximal ends of the legs having opposing portions adapted for receiving and holding a nut or a bottle cap therebetween such that the legs can be squeezed toward one another for applying a compressive force against the nut or bottle cap.

2. The combined nutcracker and bottle opener of claim 1, wherein at least one of the opposing portions includes a concave surface adapted for receiving and cradling a portion of a nut or bottle cap.

3. The combined nutcracker and bottle opener of claim 1, wherein the bottle opener comprises an edge at one end of a slot facing the distal end portion of the second leg, the slot being adapted for receiving a circumferential side of a bottle cap such that the edge can contact a lower edge of the circumferential side as the second leg contacts an upper surface portion of the bottle cap for prying the bottle cap from a bottle.

4. The combined nutcracker and bottle opener of claim 3, wherein the intermediate leg portion of the second leg comprises a concave portion adapted for receiving the upper surface portion of the bottle cap opposite the side received in the slot.

5. The combined nutcracker and bottle opener of claim 1, wherein the first leg can be pivoted to a position oriented at from about a 100° to 300° angle to the parallel position so as to be urgable against the second leg when the bottle opener is in engagement with a bottle cap on a bottle, for prying the bottle cap from the bottle.

6. The combined nutcracker and bottle opener of claim 1, wherein at least one of the opposing portions of the legs include elements for conformingly holding a side edge of a bottle cap.

7. The combined nutcracker and bottle opener of claim 1, wherein the body members have a shape resembling a human lower torso and the legs each have a shape resembling a human leg.

8. A combined nutcracker and bottle opener, comprising:

a first elongate leg having a proximal end portion, a distal end portion opposite the proximal end portion, and an intermediate leg portion extending between the proximal and distal end portions, the proximal end portion having a front surface portion, a rear surface portion, and opposite side portions extending therebetween, one of the side portions including a sidewardly and longitudinally open slot therein;

a second elongate leg having a proximal end portion, an opposite distal end portion, and an intermediate leg portion extending therebetween, the proximal end portion of the second leg having a shape and size so as to be cooperatively received in the slot of the first leg and pivotally connected thereto for relative pivotal movement of the legs about a front to rear extending axis, between a position wherein the leg portions are generally parallel and a range of positions wherein the leg portions are angularly related;

the intermediate leg portions of the legs having opposing inner surface portions adjacent to the proximal ends of the legs adapted for receiving and holding a nut or a cap on a bottle therebetween such that the legs can be grasped and squeezed toward one another for applying a compressive force against the nut or cap for cracking the nut and twisting the cap relative to the bottle; and the proximal end portion of the second leg including a bottle opener which is at least substantially concealed in the slot of the first leg when the legs are in the generally parallel closely spaced position and which is removed from the slot and in a usable position when the legs are pivoted one relative to the other to an angularly related open position.

9. The combined nutcracker and bottle opener of claim 8, wherein at least one of the opposing inner surface portions includes a concave surface adapted for receiving and cradling a portion of a nut or cap.

10. The combined nutcracker and bottle opener of claim 8, wherein the bottle opener comprises a slot facing the distal end portion of the second leg adapted for receiving a portion of a circumferential side of a bottle cap such that the second leg can be brought into contact with a top portion of the bottle cap adjacent an opposite side thereof, and an edge adjacent to the slot that can contact and apply a force against the bottle cap for prying the cap from a bottle as the second leg is brought into contact with and biased against the top portion of the bottle cap.

11. The combined nutcracker and bottle opener of claim 10, wherein the intermediate leg portion of the second leg comprises a concave portion adapted for receiving the top portion of the bottle cap opposite the side received in the slot.

12. The combined nutcracker and bottle opener of claim 8, wherein the first leg can be pivoted to a position oriented at from about a 100° to about a 300° angle to the parallel position so as to be capable of contacting and applying the biasing force against the second leg.

13. The combined nutcracker and bottle opener of claim 8, wherein the opposing inner surface portions of the legs each include a concave portion adapted for receiving and holding a portion of a side edge of a bottle cap to enable twisting the bottle cap from a bottle on which it is located.

14. A combined nutcracker and bottle opener, comprising:

a first elongate leg having a proximal end portion, a distal end portion opposite the proximal end portion, and an intermediate leg portion extending between the proximal and distal end portions, the proximal end portion having a front surface portion, a rear surface portion, and opposite side portions extending therebetween, one of the side portions including a sidewardly and longitudinally open cavity therein;

a second elongate leg having a proximal end portion, an opposite distal end portion, and an intermediate leg portion extending therebetween, the proximal end portion of the second leg being cooperatively received in the cavity of the first leg and pivotally connected thereto for relative pivotal movement of the legs generally on a plane through the side portions of the proximal end of the first leg between a position wherein the legs are at least generally parallel and a range of positions wherein the legs are angularly related, the proximal end portion of the second leg including a bottle opener which is located at least substantially within the cavity of the first leg when generally parallel with the second leg and exposed when the legs are angularly related;

the intermediate leg portions of the legs having opposing inner surface portions including opposing surface portions adjacent the proximal ends of the legs adapted for receiving and holding a nut or a bottle cap therebetween such that the legs can be squeezed toward one another for applying a sufficient compressive force against the nut for cracking the nut and for holding the bottle cap for twisting from a bottle.

15. The combined nutcracker and bottle opener of claim 14, wherein at least one of the opposing surface portions adjacent the proximal ends of the legs includes a concave surface portion adapted for receiving and holding a portion of a nut or a bottle cap.

16. The combined nutcracker and bottle opener of claim 14, wherein the portion of at least one of the opposing inner surface portions adapted for holding a bottle cap includes a layer of a rubbery material for engaging and gripping a serrated edge portion of a bottle cap.

17. The combined nutcracker and bottle opener of claim 14, wherein the portion of at least one of the opposing inner surface portions adapted for holding a bottle cap includes a longitudinally extending groove for holding an edge portion of a bottle cap.

18. The combined nutcracker and bottle opener of claim 14, wherein the portions of the opposing inner surface portions for holding a bottle cap are located adjacent to the distal ends of the legs.

19. The combined nutcracker and bottle opener of claim 14, wherein the bottle opener comprises a protruding edge spaced from the inner surface of the second leg so as to define a slot therebetween facing the distal end portion of the second leg, the slot being sufficiently wide for receiving a circumferential side portion of a bottle cap such that the protruding edge will be positioned to engage a circumferential edge of the bottle cap for prying the cap from a bottle when the second leg is brought into biased contact with an upper surface the cap spaced from the circumferential side portion.

* * * * *